US009527288B2

(12) United States Patent
Naoe

(10) Patent No.: US 9,527,288 B2
(45) Date of Patent: Dec. 27, 2016

(54) LIQUID DISCHARGING APPARATUS

(71) Applicants: SCREEN Holdings Co., Ltd., Kyoto (JP); Ricoh Company, Ltd., Tokyo (JP)

(72) Inventor: Ryoichi Naoe, Kyoto (JP)

(73) Assignees: SCREEN Holdings Co., Ltd. (JP); RICOH COMPANY, LTD. (JP)

( * ) Notice: Subject to any disclaimer, the term of this patent is extended or adjusted under 35 U.S.C. 154(b) by 0 days.

(21) Appl. No.: 14/808,512

(22) Filed: Jul. 24, 2015

(65) Prior Publication Data

US 2016/0052275 A1 Feb. 25, 2016

(30) Foreign Application Priority Data

Aug. 19, 2014 (JP) ..... 2014-166762

(51) Int. Cl.
*B41J 2/165* (2006.01)

(52) U.S. Cl.
CPC ..... *B41J 2/16511* (2013.01); *B41J 2/16538* (2013.01); *B41J 2/16544* (2013.01); *B41J 2/16585* (2013.01)

(58) Field of Classification Search
CPC ..... B41J 2/16547; B41J 2/16505; B41J 2002/16514
See application file for complete search history.

(56) References Cited

U.S. PATENT DOCUMENTS 5,608,432 A * 3/1997 Yamaguchi ..... B41J 2/16508 347/22
2012/0194607 A1* 8/2012 Iwasa ..... B41J 2/16511 347/29

FOREIGN PATENT DOCUMENTS

JP 2012-157989 8/2012
JP 5180878 4/2013

* cited by examiner

*Primary Examiner* — An Do
*Assistant Examiner* — Renee I Wilson
(74) *Attorney, Agent, or Firm* — Ostrolenk Faber LLP

(57) ABSTRACT

Provided is a liquid discharging apparatus for discharging a liquid. The liquid discharging apparatus includes droplet dischargers each discharging droplets onto a substrate, a cap unit provided with recesses covering outlets of the droplet dischargers, and movable between a retracting position away from the outlets of the droplet dischargers and a capping position in which the outlets of the droplet dischargers are closed, and a cleaner provided with absorbers contacting edges of the recesses of the cap unit, and closing the recesses in synchronization with movement of the cap unit to the retracting position.

20 Claims, 10 Drawing Sheets

LIQUID DISCHARGING APPARATUS

TECHNICAL FIELD

The present invention relates to a liquid discharging apparatus that discharges droplets from outlets. More particularly, the present invention is directed to a technique of surroundings of caps for closing nozzles.

BACKGROUND ART

Examples of such a currently-used apparatus include an apparatus as under. That is, the apparatus is provided with a printing head with a plurality of inkjet heads, a cap unit, and wiper blades. The cap unit moves between a capping position where nozzles of the inkjet heads are each closed and a retracting position where the nozzles are opened in a direction orthogonal to a direction where the inkjet heads are arranged. The wiper blades move in the direction where the inkjet heads are arranged when the cap unit is in the retracting position, thereby wiping the nozzles individually. See, for example, Japanese Patent Publication No. 2012-157989A.

The inkjet printing apparatus performs printing on a printing sheet by discharging ink droplets. Such an inkjet printing apparatus typically performs purge periodically by sucking or pressurizing all the nozzles of the printing head in order not to generate any undischarged nozzles from thickened ink droplets having enhanced viscosity. Accordingly, ink droplets accumulate on discharge faces of the printing head with outlets of all the nozzles being opened. Then the cap unit wipes the discharge faces of the printing head in its retracting position using the wiper blades. This achieves removal of the ink droplets accumulating on the discharge faces of the printing head.

On the other hand, the purge causes dispersion of the ink droplets within the cap unit. As a result, the ink droplets adhere on an inner peripheral edge of the cap unit. Accordingly, movement of the cap unit into the capping position leads to transfer of the ink droplets on a top face of the cap unit with enhanced viscosity to the discharge faces of the inkjet heads. Such transfer causes the ink droplets to be left on the discharge face of the printing head with asperities if the ink droplets continuously remain as cap impressions of the cap unit. Accordingly, uneven cleaning occurs upon wiper of the discharge face with the wiper blades. Such a drawback may arise.

Then, an apparatus has been suggested that includes a cap unit and a cleaning unit. The cap unit is disposed below a printing head and a transport path on which a printing sheet is transported. The cleaning unit is disposed between a top face of the cap unit and the transport path and is spaced away from the cap unit. See, for example, Japanese Patent No. 5180878A.

The apparatus includes the cleaning unit having lips. The lips project toward the top face of the cap unit, and lower ends thereof are each lower in level than the top face of the cap unit. When the cleaning unit is moved horizontally while the printing sheet is fed out of the transport path, the lips slide over the top face of the cap unit. Accordingly, the ink droplets on the top face of the cap unit are wiped off. Then, the cap unit is moved upward to the capping position to close the discharge faces of the printing head. Here, the top face of the cap unit is cleaned by the cleaning unit. Consequently, the discharge faces of the printing head have resistance to contamination due to the ink droplet transfer from the cap unit. This causes less cleaning unevenness.

However, the examples of the conventional apparatus with such configurations as above have the following drawbacks.

Specifically, the lips of the currently-used apparatus projecting below the top face of the cap unit slide on the top face of the cap unit. Accordingly, the top face of the cap unit becomes worn and damaged. Such a drawback may arise. In addition, the cleaning unit is spaced away from the top face of the cap unit. This leads to the dried inside of the cap unit. Consequently, the dried inside of the cap unit due to exposure to air prevents moisture retention of the nozzles upon movement of the cap unit to the capping position. Accordingly, this produces the ink droplets with the enhanced viscosity on the discharge faces of the printing head, whereby some undischarged nozzles are generated. Such a drawback may also arise.

SUMMARY OF INVENTION

The present invention has been made regarding the state of the art noted above, and its one object is to provide a liquid discharging apparatus that allows elimination of damages on caps and of increased liquid viscosity upon capping while preventing reduction in degree of cleanness due to liquid transfer.

In order to accomplish the above object, the present invention adopts the following configuration.

One embodiment of the present invention discloses a liquid discharging apparatus that discharges a liquid. The liquid discharging apparatus includes droplet dischargers, a cap unit with recesses covering outlets of the droplet dischargers, and a cleaner. The droplet dischargers each discharge droplets onto a substrate. The cap unit is movable between a retracting position away from the outlets of the droplet dischargers and a capping position in which the outlets of the droplet dischargers are closed. The cleaner is provided with absorbers contacting edges of the recesses of the cap unit, and closes the recesses in synchronization with movement of the cap unit to the retracting position.

With the embodiment of the present invention, the absorbers of the cleaner close the recesses of the cap unit in synchronization with the movement of the cap unit to the retracting position. Consequently, the cleaner allows removal of the liquid adhering on the edges of the recesses of the caps. This achieves reduction in degree of cleanness caused by liquid transfer from the cap unit to the droplet dischargers. This also achieves prevention of increase in viscosity of the liquid upon capping since the cleaner closes the recesses of the cap unit to retain moisture within the recesses. At this time, the cleaner merely contacts the recesses of the cap unit without sliding. This avoids damages on the caps.

Moreover, the following is preferable in the embodiment of the present invention. That is, the droplet dischargers are arranged in four rows in a transportation direction of the substrate. The cap unit is formed by a first cap unit and a second cap unit every two rows individually so as to correspond to the droplet dischargers. The liquid discharging apparatus further includes a cap unit moving device moving the first cap unit and the second cap unit so as to locate the second cap unit vertically below the first cap unit on a lateral side of the droplet dischargers in the retracting position and so as to locate the first cap unit and the second cap unit horizontally in the capping position.

With the embodiment of the present invention, the droplet dischargers are formed in four rows, and the cap unit is formed by the first and second cap units correspondingly.

The cap unit moving device moves the first and second cap units so as to locate the first and second cap units vertically on a lateral side of the droplet dischargers in the retracting position and horizontally in the capping position. This results in obtainment of a small exclusive area even when the first and second cap units are retracted.

Moreover, it is preferable in the embodiment of the present invention that the cleaner is formed by a first cleaner and a second cleaner. The first cleaner is disposed in the retracting position of the first cap unit, and contacts the edges of the recesses of the first cap unit to close the recesses when the first cap unit is moved to the retracting position. The second cleaner is disposed in the retracting position of the second cap unit, and contacts the edges of the recesses of the second cap unit to close the recesses when the second cap unit is moved to the retracting position.

With the embodiment of the present invention, the first cleaner contacts the edges of the recesses of the first cap unit to close the recesses, and the second cleaner contacts the edges of the recesses of the second cap unit to close the recesses. The first and second cleaners individually close the first and second cap units, respectively, ensuring closing of the respective recesses to remove a liquid on the edges of the recesses.

Moreover, it is preferable that the second cleaner according to the embodiment of the present invention includes a holder, a pivot shaft, a biasing device, and a pressed unit. The holder is disposed on a portion of the first cap unit adjacent to the second cap unit, and includes the absorbers on a side adjacent to the second cap unit. The pivot shaft is attached to the first cap unit so as for the holder to pivot between an open position adjacent to the first cap unit and a close position adjacent to the second cap unit. The biasing device biases the holder into the open position. The pressed unit is provided on the holder, and is pressed upon movement of the second cap unit to the retracting position, thereby moving the holder to the close position.

With the embodiment of the present invention, the holder is biased into the open position by the biasing device and is folded into the first cap unit with no pressure applied to the pressed unit. Consequently, no interference occurs between the second cleaner and the second cap unit when the first and second cap units are moved to the retracting position to have a vertical positional relationship. On the other hand, when the second cap unit presses the pressed unit, the holder is moved to the close position. This ensures closing of the recesses of the second cap unit with the absorbers of the holder to remove the liquid on the edges of the recesses.

Moreover, the liquid according to the embodiment of the present invention is preferably ink droplets.

The present invention is suitably implemented in the inkjet printing apparatus according to the embodiment of the present invention that uses the ink droplets as the liquid.

BRIEF DESCRIPTION OF DRAWINGS

For the purpose of illustrating the invention, there are shown in the drawings several forms which are presently preferred, it being understood, however, that the invention is not limited to the precise arrangement and instrumentalities shown.

DESCRIPTION OF EMBODIMENTS

The following describes a preferred embodiment of the present invention with reference to drawings.

Figure 1:
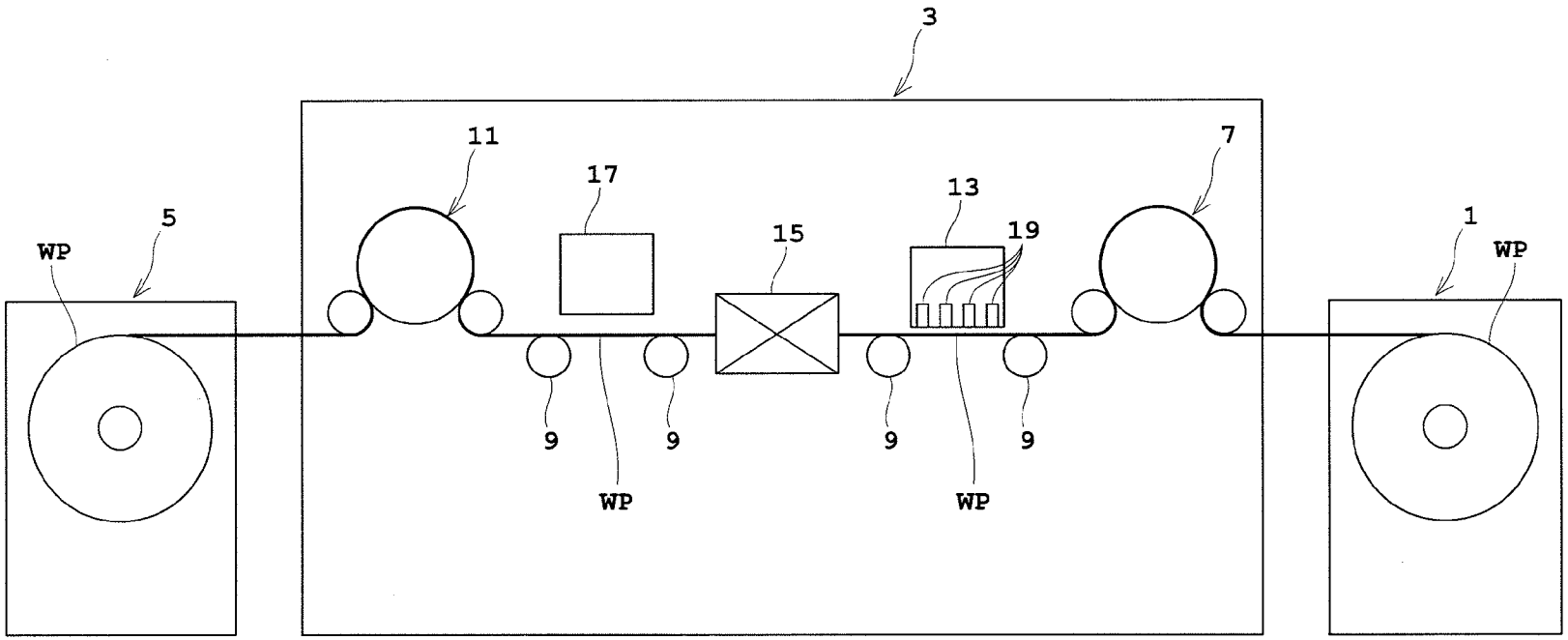
FIG. 1 is a schematic view illustrating an entire inkjet printing system according to one embodiment of the present invention.

FIG. 1 a schematic view illustrating an entire inkjet printing system according to one embodiment of the present invention.

The inkjet printing system according to one embodiment of the present invention includes a paper feeder 1, an inkjet printing apparatus 3, and a take-up roller 5.

The paper feeder 1 holds the web paper WP in a roll form to be rotatable about a horizontal axis. The paper feeder 1 unwinds and feeds the web paper WP to the inkjet printing apparatus 3. The take-up roller 5 winds up the web paper WP printed by the inkjet printing apparatus 3 about a horizontal axis. Regarding the side from which the web paper WP is fed as upstream and the side to which the web paper WP is fed out as downstream, the paper feeder 1 is disposed upstream of the inkjet printing apparatus 3, whereas the take-up roller 5 is disposed downstream of the inkjet printing apparatus 3.

The inkjet printing apparatus 3 includes a drive roller 7 upstream thereof for taking in the web paper WP from the paper feeder 1. The web paper WP unwound from the paper feeder 1 by the drive roller 7 is transported downstream toward the take-up roller 5 along a plurality of transport rollers 9. A drive roller 11 is disposed between the most downstream transport roller 9 and the take-up roller 5. The drive roller 11 feeds the web paper WP travelling on the transport rollers 9 toward the take-up roller 5.

Between the drive rollers 7 and 11, the inkjet printing apparatus 3 includes a print unit 13, a drier 15, and an inspecting unit 17 arranged in this order from upstream. The drier 15 dries portions printed by the print unit 13. The inspecting unit 17 inspects the printed portions for any stains or omissions.

The print unit 13 has a plurality of printing heads 19 for discharging ink droplets. A plurality of print units 13 is typically disposed along the transportation direction of the web paper WP. For instance, four print units 13 are provided separately for black (K), cyan (C), magenta (M), and yellow (Y). However, in order to facilitate understanding of the present invention, the following description will be given on the assumption that only one printer 13 is provided. Moreover, the print unit 13 includes a plurality of inkjet heads 19 in a direction orthogonal to the transportation direction of the web paper WP. The print unit 13 has enough inkjet heads 19 to perform printing without moving over a printing area in the width direction of the web paper WP. That is, the inkjet printing apparatus 3 in the present embodiment performs printing on the web paper WP being fed thereto, with the inkjet heads 19 not moving for primary scanning but remaining stationary in the horizontal direction orthogonal to the transport direction of the web paper WP.

The web paper WP corresponds to the "substrate" in the present invention.

Figure 2:
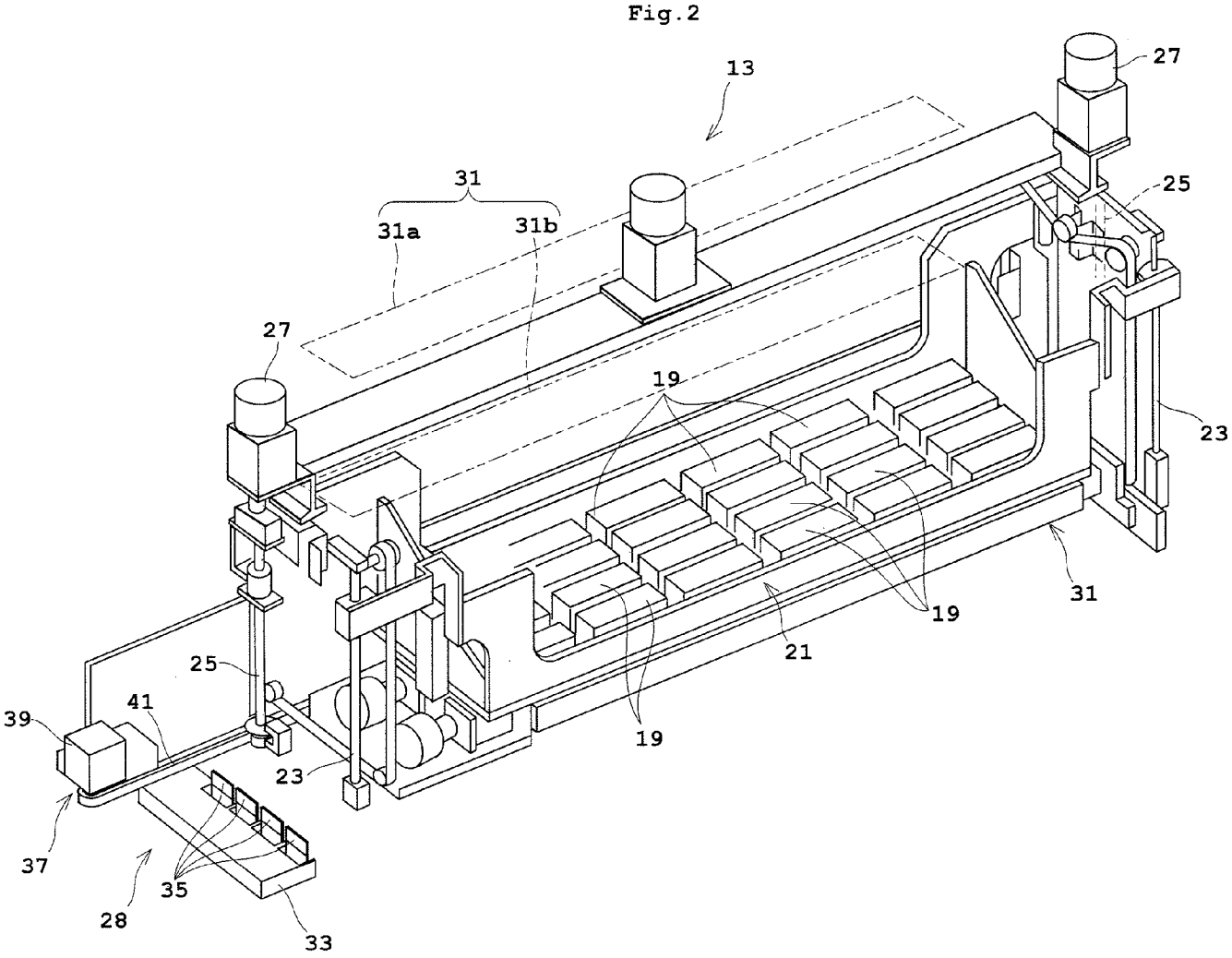
FIG. 2 is a perspective view of a print unit according to the embodiment.
Figure 3:
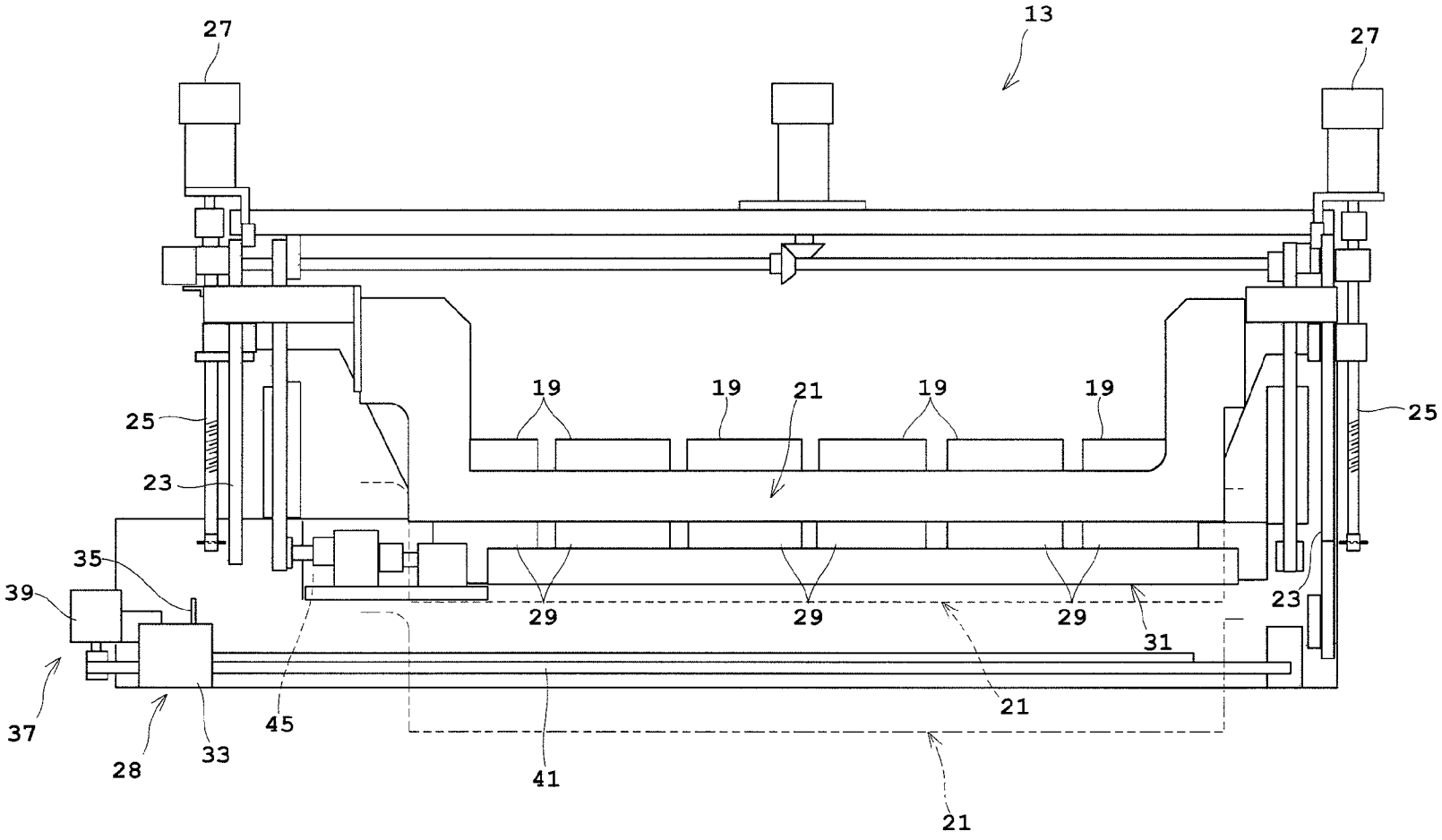
FIG. 3 is a front view of the print unit.

Here, the following describes the above print unit 13 in detail with reference to FIGS. 2 and 3. FIG. 2 is a perspective view of the print unit. FIG. 3 is a front view of the print unit.

The print unit 13 of the present embodiment includes twenty-four inkjet heads 19 and an inkjet head holder 21 holding the inkjet heads 19 collectively. The inkjet head holder 21 holds the twenty-four inkjet heads 19 while six of the twenty-four inkjet heads 19 are arranged in one row in the direction orthogonal to the transportation direction of the web paper WP and four rows are arranged in the transportation direction of the web paper WP. The inkjet heads 19 each pass through a bottom of the inkjet head holder 21 to discharge ink droplets from a lower surface of the inkjet head holder 21 to the web paper WP. The number of inkjet heads 19 of the inkjet head holder 21 is not limited by twenty-four as in the present embodiment.

The inkjet head 19 corresponds to the "droplet discharger" in the present invention.

Linear guides 23 are disposed substantially vertically on both sides of the inkjet head holder 21 (a width direction of the web paper WP). The linear guides 23 are paired, and guides and holds the inkjet head holder 21 liftably. Moreover, a pair of ball screws 25 is disposed on both sides of the inkjet head holder 21 substantially vertically. The inkjet head holder 21 is threadably mounted on the pair of ball screws 25 via nuts not shown. A pair of motors 27 on both upper sides of the inkjet head holder 21 rotatably drives the pair of ball screws 25 respectively around a vertical axis. Consequently, operation of the paired motors 27 causes the inkjet head holder 21 to move vertically.

The inkjet head holder 21 is moved vertically among three levels, i.e., a "maintenance level" denoted by solid lines in FIG. 3, a "wiper level" denoted by dotted lines in FIG. 3, and a "printing level" denoted by chain double-dashed lines in FIG. 3. In the wiper level, a wiper unit 28 illustrated on the left of FIGS. 2 and 3 is moved horizontally along the inkjet head 19, whereby foreign substances adhering on the discharge faces of the inkjet heads 19 are wiped off.

The print unit 13 includes twenty-four caps 29 corresponding to the twenty-four inkjet heads 19. The caps 29 each close a surrounding of the discharge face of the inkjet head 19 having the opened ink outlet. The caps 29 each prevent drying and contamination around the ink outlet of the inkjet head 19. The caps 29 are held with a cap holder 31.

The cap holder 31 is movable between two positions while holding the caps 29. The two positions are a "capping position" disposed immediately below the inkjet head holder 21 as in FIG. 3, and a "retracting position" behind the inkjet head holder 21 along the back face in side view (i.e., behind the plane of FIG. 3). Here, the retracting position is denoted by chain double-dashed lines in FIG. 2.

The wiper unit 28 is provided with a base 33, four wiper blades 35, and a wiper drive unit 37. In the present embodiment, the four wiper blades 35 are disposed linearly in row. However, when two colors of ink droplets are used, the wiper blades 35 in two rows may be provided as one unit. Moreover, when four colors of ink droplets are used, the wiper blades 35 in four rows may be provided as one unit.

The base 33 are elongated in the transportation direction of the web paper WP. The base 33 has the four wiper blades 35 disposed thereon on a side adjacent to the inkjet head 19 linearly in the transportation direction in plan view. The wiper blades 35 are sheeted resins. The wiper blades 35 are wide in the transportation direction of the web paper WP, and are thin in the width direction of the web paper WP. The base 33 has a wiper drive unit 37 disposed on a proximal end thereof (adjacent to the back face of the inkjet head 19). The wiper drive unit 37 includes a motor 39 and a timing belt 41. The timing belt 41 is arranged along a lower face of the inkjet head 19 in the wiper position from a side adjacent to the motor 39 to a side opposite thereto across the transportation direction of the web paper WP. The timing belt 41 is suspended between a rotary shaft of the motor 39 and a pulley (not shown) on an opposite side across the transportation direction of the web paper WP. The base 33 is fixed on a part of the timing belt 41. Consequently, driving the motor 39 causes the wiper blades 35 to move along the lower face of the inkjet heads 19 in the width direction of the web paper WP, thereby wiping off ink droplets or foreign substances adhering on the discharge faces of the inkjet heads 19. FIGS. 2 and 3 each illustrate a "standby position" of the wiper unit 28.

Figure 4:
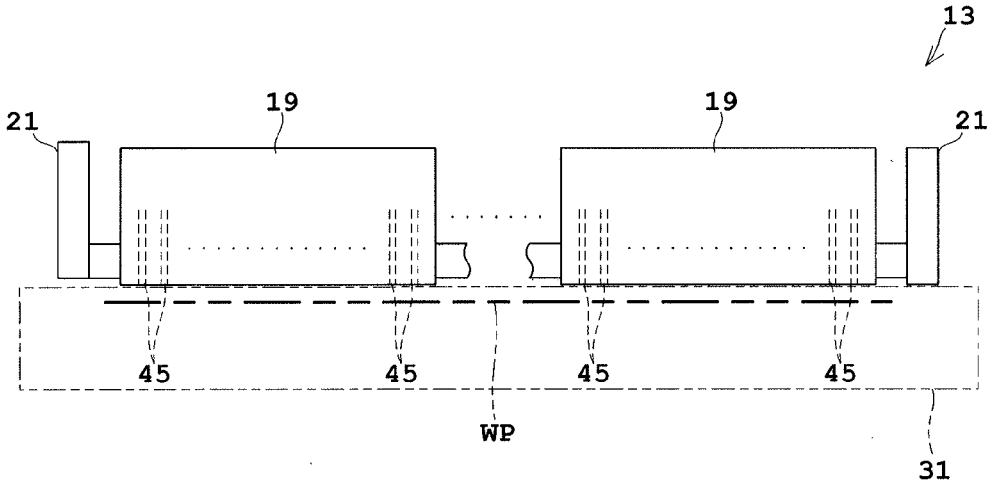
FIG. 4 is a schematic front view of the print unit upon printing.
Figure 5:
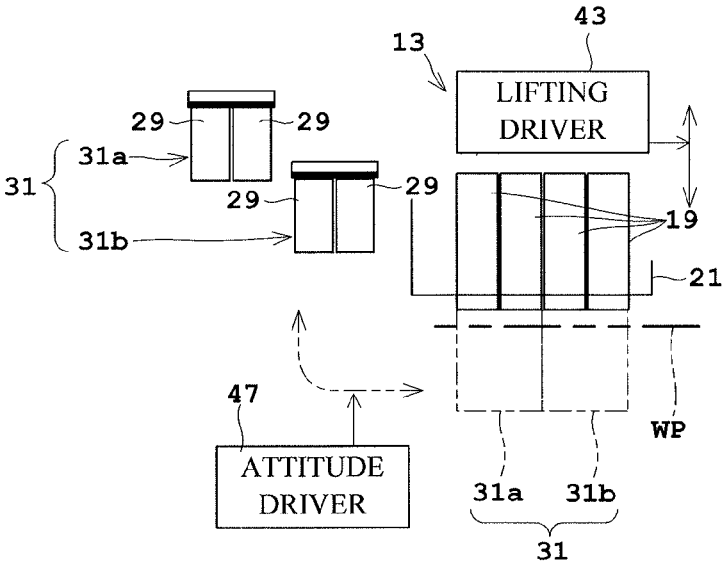
FIG. 5 is a schematic side view of the print unit upon printing.
Figure 6:
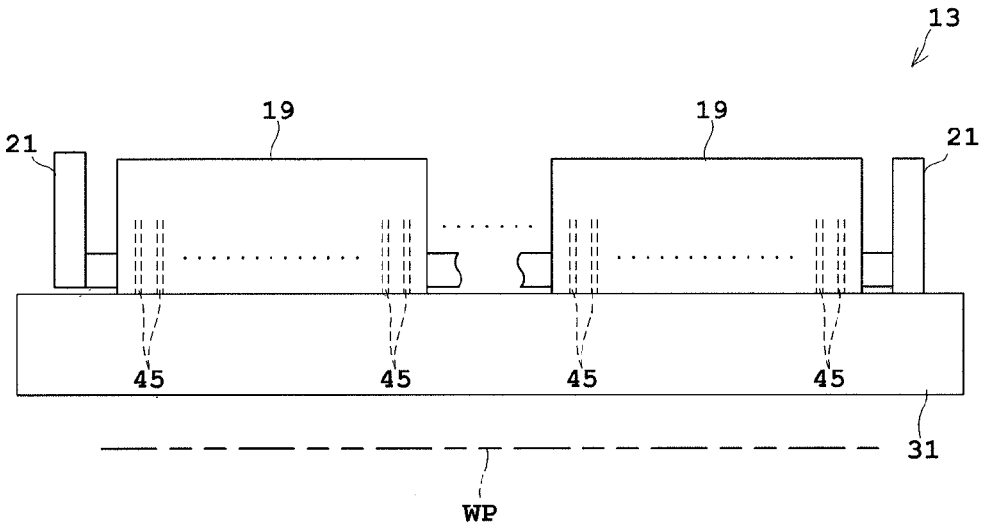
FIG. 6 is a schematic front view of the print unit upon maintenance.
Figure 7:
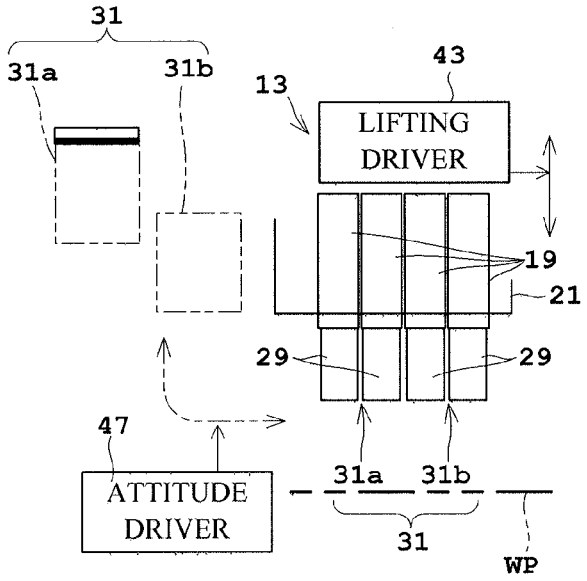
FIG. 7 is a schematic side view of the print unit upon maintenance.
Figure 8:
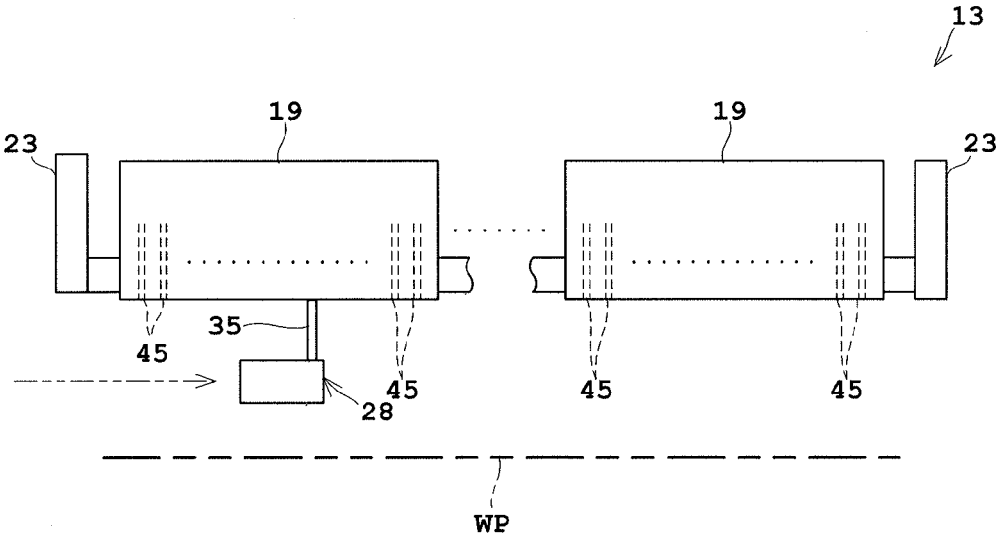
FIG. 8 is a schematic front view of the print unit upon wiper with a wiper unit.
Figure 9:
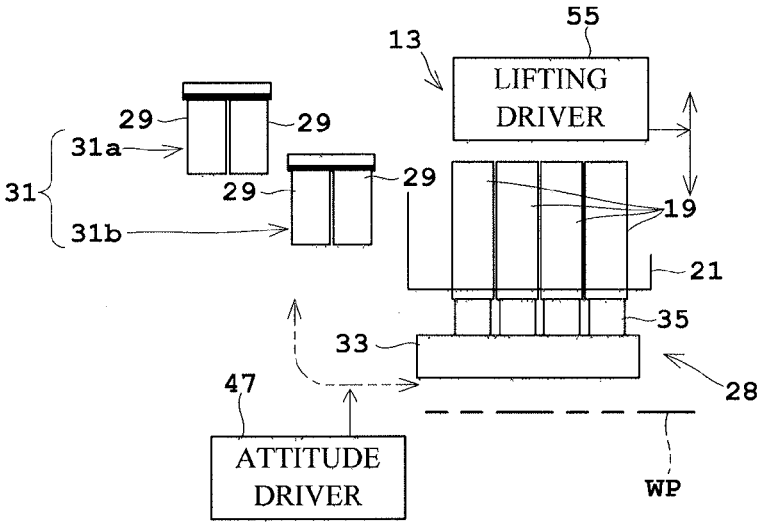
FIG. 9 is a schematic side view of the print unit upon wiper with the wiper unit.

Now reference is made to FIGS. 4 to 9. FIG. 4 is a schematic front view of the print unit upon printing. FIG. 5 is a schematic side view of the print unit upon printing. FIG. 6 is a schematic front view of the print unit upon maintenance. FIG. 7 is a schematic side view of the print unit upon maintenance. FIG. 8 is a schematic front view of the print unit upon wiper with the wiper unit. FIG. 9 is a schematic side view of the print unit upon wiper with the wiper unit.

The inkjet head holder 21 holding the inkjet heads 19 is vertically movable with a lifting driver 43 formed by the motors 27 and the like. Specifically, the inkjet head holder 21 is movable between the "printing level" in FIGS. 4 and 5 and the "maintenance level" in FIGS. 6 and 7. As illustrated in FIGS. 4 and 5, the printing level is a level where the outlets 45 opened in the discharge faces of the inkjet heads 19 approach the top face of the web paper WP. In contrast to this, the maintenance level is a level where the discharge faces of the inkjet heads 19 are above the printing level and are largely spaced away from the top face of the web paper WP.

The cap holder 31 to be described in detail in later is formed by individual cap holders 31*a* and 31*b* each corresponding to adjacent two rows of the four inkjet heads 19 in the transportation direction of the web paper WP. As illustrated in FIG. 2, the cap holder 31*a* holds the caps 29 in two rows corresponding to the inkjet heads 19 in two rows of the inkjet heads 19 in four rows adjacent to the back face. In contrast to this, the cap holder 31*b* holds the caps 29 in two rows corresponding to the inkjet heads 19 in the left two rows of the four rows, as illustrated in FIG. 2.

Here, the cap holder 31 corresponds to the "cap unit" in the present invention. The cap holder 31*a* corresponds to the "first cap unit" in the present invention, and the cap holder 31*b* corresponds to the "second cap unit" in the present invention.

The following simply describes movement of the cap holder 31. The cap holder 31 is moved with an attitude driver 47 as under. That is, the cap holder 31 is lifted vertically while moving to a lower side and a back side of the inkjet head holder 21 in accordance with vertical movement of the inkjet head holder 21 between the printing level and the maintenance level. Specifically, when the inkjet head holder 21 is located at the printing level in FIGS. 4 and 5, the cap holder 31 is turned to the back side of the inkjet head holder 21 (the left of FIG. 5) and is moved to the "retracting position" higher than the discharge faces of the inkjet heads 19. When the inkjet head holder 21 is located at the maintenance level in FIGS. 6 and 7, the cap holder 31 is moved to the "capping position" between the discharge faces of the inkjet heads 19 and the web paper WP.

The attitude driver 47 corresponds to the "cap unit moving device" in the present invention.

When the inkjet head holder 21 is located at the wiper level, moving the motor 39 allows reciprocation of the wiper unit 28 in the standby position in FIGS. 2 and 3 along the discharge faces of the inkjet heads 19 in the width direction of the web paper WP, as illustrated in FIGS. 8 and 9. This achieves removal of ink droplets and foreign substances on the discharge faces of the inkjet heads 19 using the wiper blades 35.

Figure 10:
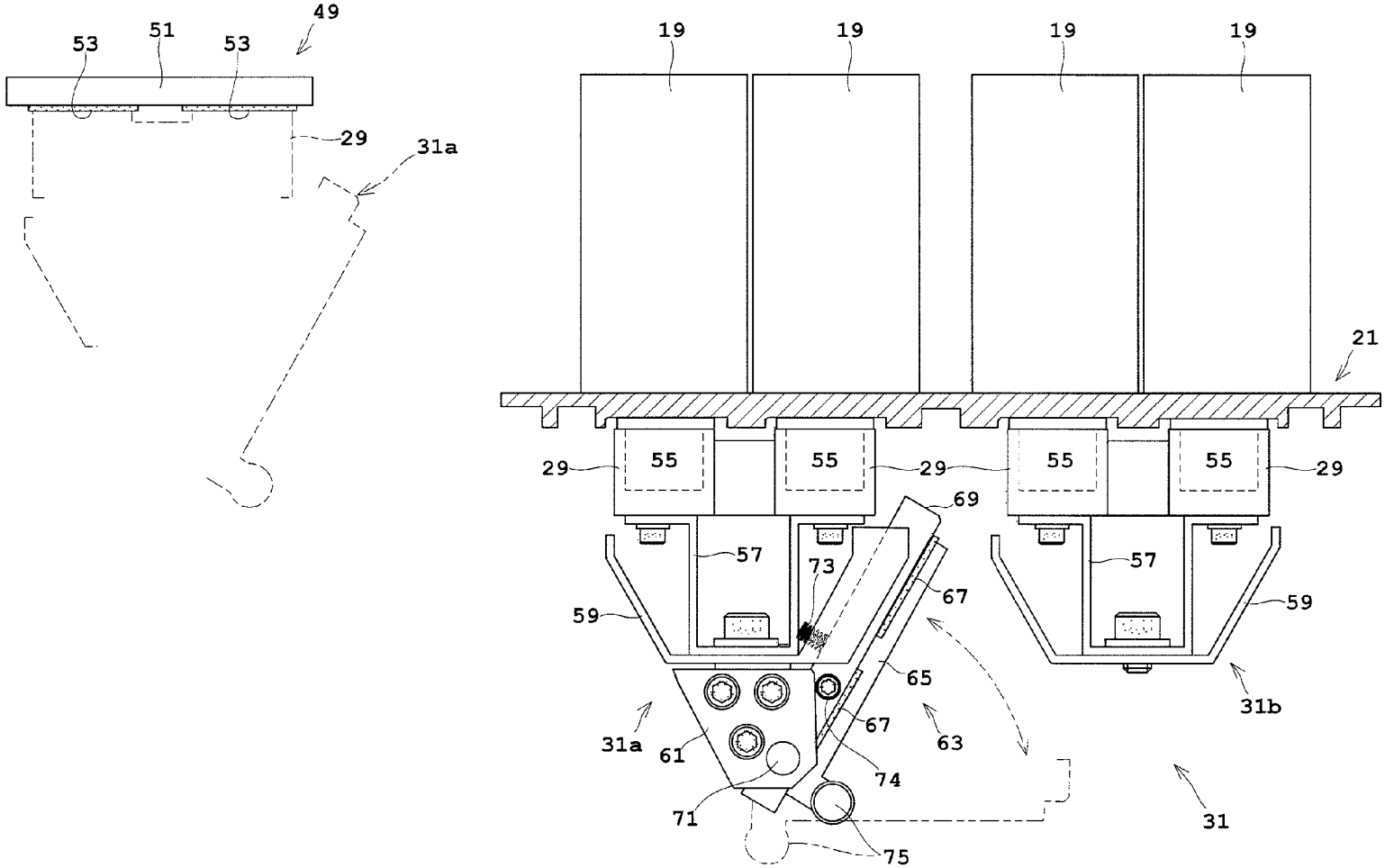
FIG. 10 is a side view upon capping.
Figure 11:
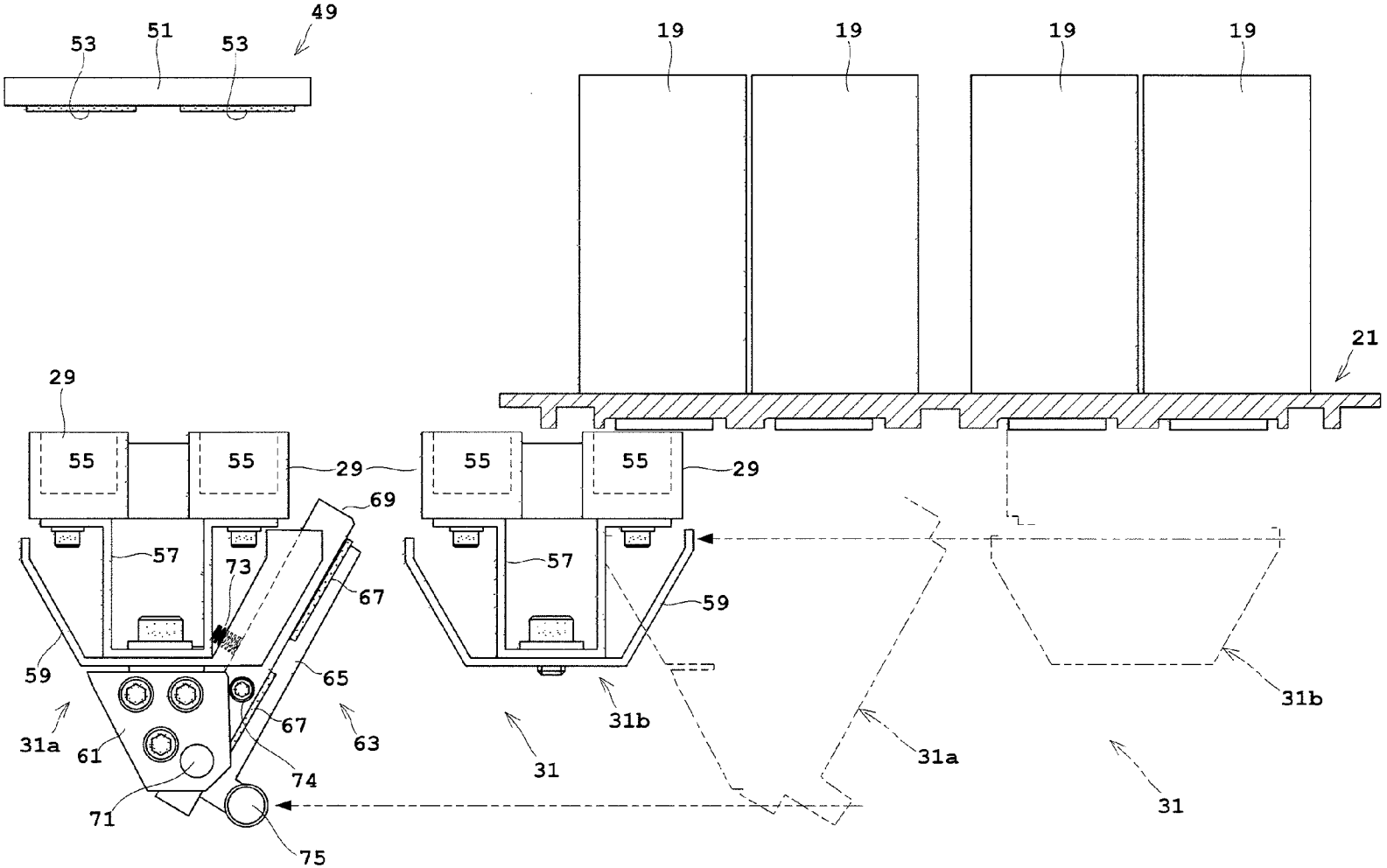
FIG. 11 is a side view of starting movement to a retracting position.
Figure 12:
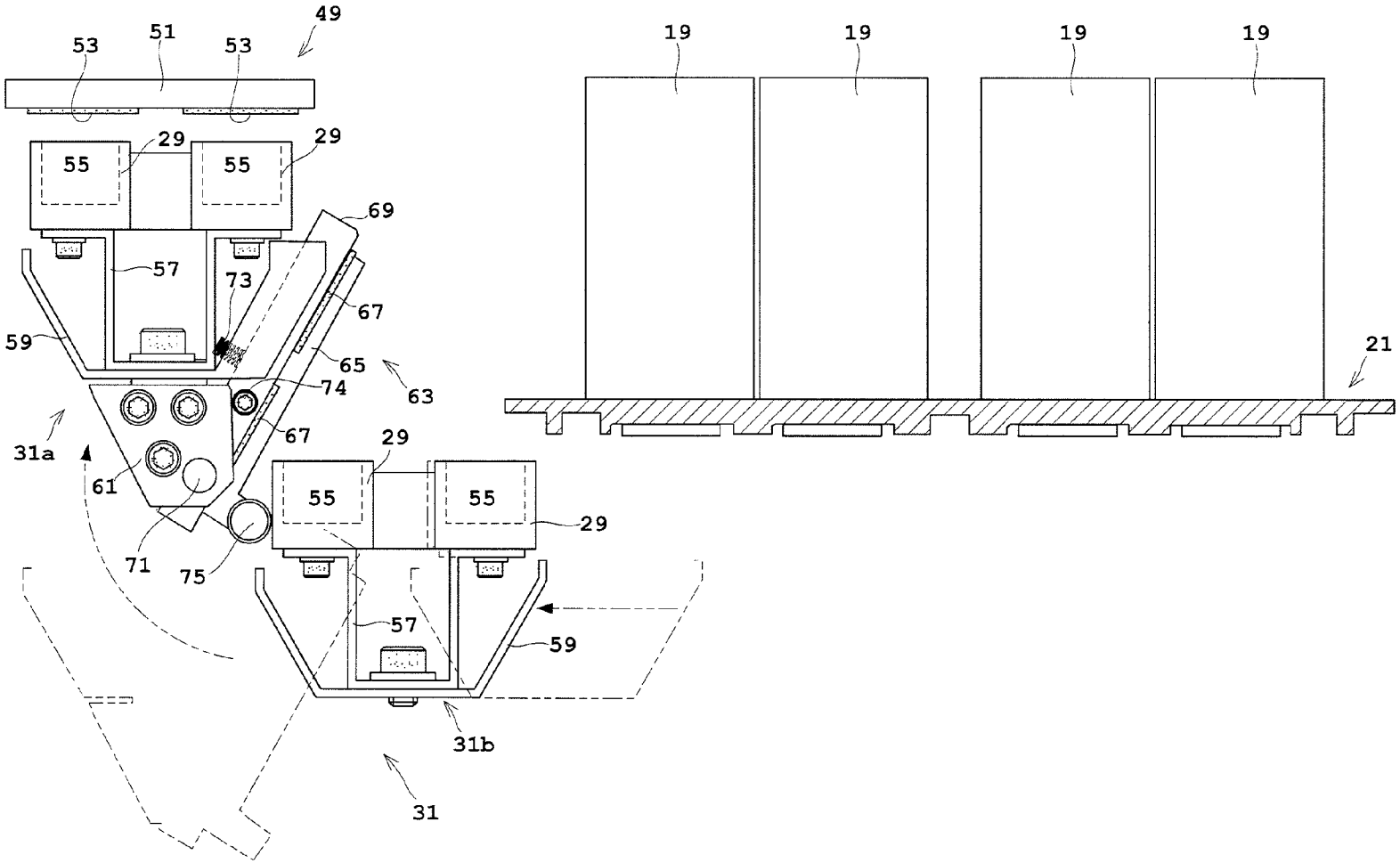
FIG. 12 is a side view of the retracting position before a close position.
Figure 13:
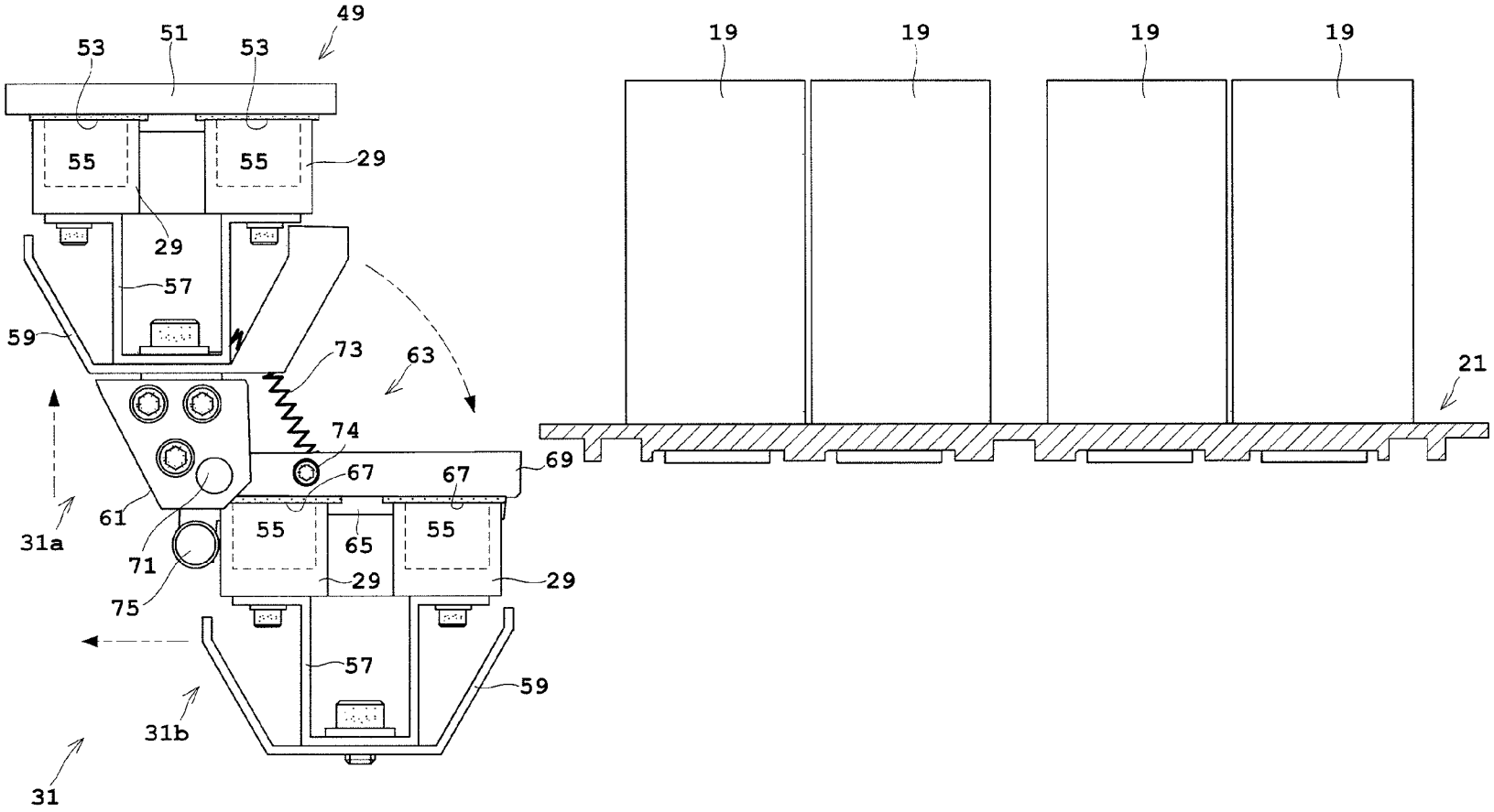
FIG. 13 is a side view of the retracting position in the close position.

The following describes in detail the cap holder 31 and the surroundings as well as the movement thereof with reference to FIGS. 10 to 13. FIG. 10 is a side view upon capping. FIG. 11 is a side view of starting movement of the cap holder 31 to a retracting position. FIG. 12 is a side view of the retracting position before a close position. FIG. 13 is a side view of the retracting position in the close position.

In the initial state in FIG. 10, the inkjet head holder 21 is at the maintenance level, and the cap holder 31 is in the capping position.

The following firstly describes the details of the cap holder 31 and its surroundings.

A first cleaner 49 is fixedly located on the back face side of the inkjet head holder 21 (behind the plane of FIG. 3, the left of FIG. 10). Such a position is at a level where upper edges of the caps 29 contact the first cleaner 49 upon movement of the cap holder 31 to the retracting position. The first cleaner 49 includes a holder frame 51 and absorbers 53. The holder frame 51 has a size so as to cover the upper of the caps 29 in two rows of the cap holder 31*a*. The holder frame 51 holds the absorbers 53 at the lower faces thereof. The absorbers 53 readily absorb the ink droplets. Examples of the absorber 53 include a sponge. The absorbers 53 each have a size so as to cover the top face of the cap 29.

As mentioned above, the cap holder 31 includes the caps 29 every two rows individually so as to cover the discharge faces of the inkjet heads 19 in two rows. The cap holder 31 is formed by a cap holder 31*a* on the back side and a cap holder 31*b* on the front side thereof. The caps 29 each have a recess 55 formed therein whose top face is open. The recess 55 closes the outlet 45 of the inkjet head 19, and stores the purged ink droplets.

The cap holder 31*a* includes a holder 57, a holder cover 59, an attaching frame 61, and a second cleaner 63.

The caps 29 in two rows are attached to the holder 57. The holder cover 59 covers the lower face and front and rear faces of the holder 57 below the holder 57. The holder cover 59 is shaped so as for an outer face thereof to be directed and tapered downward. The attaching frame 61 is attached to the lower face of the holder cover 59 to project downward. The second cleaner 63 is disposed adjacent to the right side face of the holder cover 59 and on the right of the attaching frame 61.

The second cleaner 63 includes a holder frame 65, absorbers 67, a movable frame 69, a pivot shaft 71, and a tension coil spring 73.

The holder frame 65 has a size so as to cover the upper of the caps 29 in two rows of the cap holder 31*b* adjacent to the front side. The holder frame 65 holds the absorbers 67. The holder frame 65 is L-shaped, and has a pressed unit 75 formed in a position where the attaching frame 61 extends diagonally downward. The holder frame 65 is fixed on the movable frame 69. The movable frame 69 is attached to the attaching frame 61 so as for the lower end thereof to be swingable via the pivot shaft 71. At this time, the absorbers 67 are disposed diagonally upward and the faces thereof are directed downward. The tension coil spring 73 is provided between the movable frame 69 and the holder 57. This causes the movable frame 69 to be biased toward the holder 57 in a normal state, and to be directed diagonally downward in a received state. The movable frame 69 includes a regulating pin 74 on the side face thereof. The regulating pin 74 contacts the biased movable frame 69 biased by the tension coil spring 73 to the edge of the attaching frame 61 to regulate a position of the movable frame 69. The absorber 67 is made of the same material as the absorber 53 mentioned above. The absorber 67 has a size so as to cover the top faces of the caps 29 in two rows of the cap holder 31*b* adjacent to the front side.

The holder frame 65 corresponds to the "holder" in the present invention. The tension coil spring 73 correspond to the "biasing device" in the present invention.

The cap holder 31*b* includes the holder 57 and the holder cover 59. The caps 29 in two rows are attached to the holder 57. The holder cover 59 covers the lower face and front and rear faces of the holder 57 below the holder 57. The holder cover 59 is shaped so as for the outer side face to be directed and tapered downward.

The following describes movement of the cap holder 31*b* to the retracting position.

As illustrated in FIG. 11, the attitude driver 47 moves the cap holders 31*a* and 31*b* horizontally from the capping position to the back face side where the first cleaner 49 is disposed. At this time, the cap holder 31*a* is disposed below the first cleaner 49. The second cleaner 63 is kept received in the cap holder 31*a* in an open position.

Newt, as illustrated in FIG. 12, the attitude driver 47 changes movement of only the cap holder 31*a* from a horizontal direction to a vertical direction to move upward so as for the cap holder 31*a* to approach the first cleaner 49. The attitude driver 47 additionally moves the cap holder 31*b* horizontally. As a result, the cap 19 of the cap holder 31*b* adjacent to the cap holder 31*a* contacts the pressed unit 75 of the second cleaner 63 on the back face side thereof. At this time, the second cleaner 63 is kept received in the cap holder 31*a* in the open position.

Next, as illustrated in FIG. 13, the attitude driver 47 further moves only the cap holder 31*a* upward so as for the cap holder 31*a* to further approach the first cleaner 49. As a result, the absorbers 53 of the first cleaner 49 close the recesses 55 of the caps 29 of the cap holder 31*a*. The attitude driver 47 further moves the cap holder 31*b* horizontally. As a result, the cap 29 of the cap holder 31*b* presses the pressed unit 75. Accordingly, the movable frame 69 of the second cleaner 63 is swung clockwisely around the pivot shaft 71 to extend from an oblique attitude to a horizontal attitude. Consequently, the absorbers 67 of the second cleaner 63 are moved to a close position where the recesses 55 of the caps 29 are closed.

When the cap holder 31 is moved from the retracting position to the capping position, the tension coil spring 73 operates so as for the second cleaner 63 to be received in the cap holder 31*a* in the oblique attitude as illustrated in FIG.

10. This allows smooth movement of the cap holder 31*a* into the capping position with no interference with the cap holder 31*b*.

With the present embodiment, the first cleaner 49 and the second cleaner 63 close the recesses 55 of the cap holders 31*a* and 31*b*, respectively, in association with the movement of the cap unit 31 to the retracting position. Consequently, the absorbers 53 and 67 of the first cleaner 49 and the second cleaner 63, respectively, can absorb the ink droplets adhering on the upper edges of the recesses 55 of the caps 29. This allows suppression of reduction in degree of cleanness caused by transfer of the ink droplets from the cap holder 31 to the inkjet heads 19. In addition, the first cleaner 49 and the second cleaner 63 close the recesses 55 of the cap holders 31*a* and 31*b*, respectively, to retain moisture. This also suppression of the ink droplets with increased viscosity upon capping. At this time, the first cleaner 49 and the second cleaner 63 merely contact the recesses 55 of the cap holders 31*a* and 31*b*, respectively, and thus are not swung strongly. Consequently, damages on the caps are avoidable.

In the present embodiment, the inkjet heads 19 are arranged in four rows, and the cap holder 31 is formed by the cap holders 31*a* and 31*b* correspondingly. The attitude driver 49 moves the cap holders 31*a* and 31 *b* so as for the cap holders 31*a* and 31*b* to be arranged vertically on the lateral side of the inkjet heads 19 in the retracting position and to be arranged horizontally in the capping position. This achieves a small exclusive area even when the cap holders 31*a* and 31*b* are in the retracting position.

Moreover, with the present embodiment, the first cleaner 49 contacts the upper edges of the recesses 55 of the cap holder 31*a* to close the recesses 55. The second cleaner 63 contacts the upper edges of the recesses 55 of the cap holder 31*b*, thereby closing the recesses 55. The cap holders 31*a* 31*b* are individually closed with the first cleaner 49 and the second cleaner 63, respectively. This ensures closing of the recesses 55 individually.

Furthermore, in the present embodiment, the tension coil spring 73 is biased to the open position to fold the holder frame 65 into the cap holder 31*a* when the pressed unit 75 is not pressed. Accordingly, the second cleaner 63 is not interfered with the cap holder 31*b* when the cap holders 31*a* and 31*b* are moved to the retracting position to be arranged vertically. On the other hand, when the pressed unit 75 is pressed with the cap holder 31*b*, the holder frame 65 is moved to the close position. This ensures closing of the recesses 55 of the cap holder 31*b* with the absorbers 67 of the holder frame 65.

The present invention is not limited to the foregoing examples, but may be modified as follows.

(1) The present embodiment mentioned above has been described taking the web paper WP as one example of the substrate. However, the substrate is not limited to the web paper WP in the present invention. Other examples of the substrate include a paper sheet or a film.

(2) In the present embodiment mentioned above, the second cleaner 63 is received in the cap holder 31*a*. However, this is not limitative in the present invention. For instance, the second cleaner 63 may slide horizontally across the cap holder 31*a* opposite to the cap holder 31*b* in FIG. 13, and may be moved horizontally into the position as in FIG. 13 upon closing.

(3) In the present embodiment mentioned above, the inkjet heads 19 in four rows are provided and the cap holders 31*a* and 31*b* in two rows respectively are provided. However, this is not limitative. For instance, one cap holder 31 with four rows being integrated may be provided.

(4) The present embodiment has been described taking the inkjet printing apparatus 3 as one example that discharges ink droplets for a liquid. However, the present invention is applicable to an apparatus that discharges a liquid other than ink droplets. For instance, examples of the liquid in the present invention include a functional liquid that cures after being discharged.

The present invention may be embodied in other specific forms without departing from the spirit or essential attributes thereof and, accordingly, reference should be made to the appended claims, rather than to the foregoing specification, as indicating the scope of the invention.

What is claimed is:

1. A liquid discharging apparatus for discharging a liquid, the liquid discharging apparatus comprising;

droplet dischargers each arranged for discharging droplets onto a substrate;

a cap unit provided with recesses arranged for covering outlets of the droplet dischargers, and movable between a retracting position away from the outlets of the droplet dischargers and a capping position in which the outlets of the droplet dischargers are closed;

a cleaner provided with absorbers arranged for contacting edges of the recesses of the cap unit when the cap unit is disposed in the retracting position; and a cap unit moving device arranged for synchronizing the movement of the cap unit to the retracting position, and the closing of the recesses by the absorbers when the cap unit is disposed at the retracting position.

2. The liquid discharging apparatus according to claim 1, wherein the droplet dischargers are arranged in four rows in a transportation direction of the substrate, the cap unit is formed by a first cap unit and a second cap unit every two rows individually so as to correspond to the droplet dischargers, and the cap unit moving device moving the first cap unit and the second cap unit so as to locate the second cap unit vertically below the first cap unit on a lateral side of the droplet dischargers in the retracting position and so as to locate the first cap unit and the second cap unit horizontally in the capping position.

3. The liquid discharging apparatus according to claim 2, wherein the liquid is ink droplets.

4. The liquid discharging apparatus according to claim 3, wherein the retracting position is higher than the discharge faces of the droplet dischargers.

5. The liquid discharging apparatus according to claim 2, wherein the retracting position is higher than the discharge faces of the droplet dischargers.

6. The liquid discharging apparatus according to claim 2, wherein the absorbers are each a sponge.

7. The liquid discharging apparatus according to claim 1, wherein the liquid is ink droplets.

8. The liquid discharging apparatus according to claim 7, wherein the retracting position is higher than the discharge faces of the droplet dischargers.

9. The liquid discharging apparatus according to claim 1, wherein the retracting position is higher than the discharge faces of the droplet dischargers.

10. The liquid discharging apparatus according to claim 1, wherein the absorbers are each a sponge.

11. A liquid discharging apparatus for discharging a liquid, the liquid discharging apparatus comprising:

droplet dischargers each arranged for discharging droplets onto a substrate;

a cap unit provided with recesses arranged for covering outlets of the droplet dischargers, and movable between a retracting position away from the outlets of the droplet dischargers and a capping position in which the outlets of the droplet dischargers are closed; and a cleaner provided with absorbers arranged for contacting edges of the recesses of the cap unit, and closing the recesses in synchronization with movement of the cap unit to the retracting position, wherein the droplet dischargers are arranged in a plurality of rows in a transportation direction of the substrate, the cap unit is formed by a first cap unit and a second cap unit arranged for respective groups of said rows individually so as to correspond to the droplet dischargers, and the liquid discharging apparatus further includes a cap unit moving device moving the first cap unit and the second cap unit so as to locate the second cap unit vertically below the first cap unit on a lateral side of the droplet dischargers in the retracting position and so as to locate the first cap unit and the second cap unit horizontally in the capping position, and the cleaner is formed by a first cleaner and a second cleaner, the first cleaner being disposed in the retracting position of the first cap unit, and contacting the edges of the recesses of the first cap unit to close the recesses when the first cap unit is moved to the retracting position, and the second cleaner being disposed in the retracting position of the second cap unit, and contacting the edges of the recesses of the second cap unit to close the recesses when the second cap unit is moved to the retracting position.

12. The liquid discharging apparatus according to claim 11, wherein the liquid is ink droplets.

13. The liquid discharging apparatus according to claim 12, wherein the retracting position is higher than the discharge faces of the droplet dischargers.

14. The liquid discharging apparatus according to claim 11, wherein the retracting position is higher than the discharge faces of the droplet dischargers.

15. The liquid discharging apparatus according to claim 11, wherein the absorbers are each a sponge.

16. A liquid discharging apparatus for discharging a liquid, the liquid discharging apparatus comprising:

droplet dischargers each arranged for discharging droplets onto a substrate;

a cap unit provided with recesses arranged for covering outlets of the droplet dischargers, and movable between a retracting position away from the outlets of the droplet dischargers and a capping position in which the outlets of the droplet dischargers are closed; and a cleaner provided with absorbers arranged for contacting edges of the recesses of the cap unit, and closing the recesses in synchronization with movement of the cap unit to the retracting position, wherein the droplet dischargers are arranged in a plurality of rows in a transportation direction of the substrate, the cap unit is formed by a first cap unit and a second cap unit arranged for respective groups of said rows individually so as to correspond to the droplet dischargers, and the liquid discharging apparatus further includes a cap unit moving device moving the first cap unit and the second cap unit so as to locate the second cap unit vertically below the first cap unit on a lateral side of the droplet dischargers in the retracting position and so as to locate the first cap unit and the second cap unit horizontally in the capping position, the cleaner is formed by a first cleaner and a second cleaner, the first cleaner being disposed in the retracting position of the first cap unit, and contacting the edges of the recesses of the first cap unit to close the recesses when the first cap unit is moved to the retracting position, and the second cleaner being disposed in the retracting position of the second cap unit, and contacting the edges of the recesses of the second cap unit to close the recesses when the second cap unit is moved to the retracting position, and the second cleaner includes a holder, a pivot shaft, a biasing device, and a pressed unit, the holder being disposed on a portion of the first cap unit adjacent to the second cap unit, and including the absorbers on a side adjacent to the second cap unit, the pivot shaft being attached to the first cap unit so as for the holder to pivot between an open position adjacent to the first cap unit and a close position adjacent to the second cap unit, the biasing device biasing the holder into the open position, and the pressed unit being provided on the holder, and being pressed upon movement of the second cap unit to the retracting position, thereby moving the holder to the close position.

17. The liquid discharging apparatus according to claim 16, wherein the liquid is ink droplets.

18. The liquid discharging apparatus according to claim 17, wherein the retracting position is higher than the discharge faces of the droplet dischargers.

19. The liquid discharging apparatus according to claim 16, wherein the retracting position is higher than the discharge faces of the droplet dischargers.

20. The liquid discharging apparatus according to claim 16, wherein the absorbers are each a sponge.

* * * * *